US008967442B2

(12) United States Patent
Fuwa

(10) Patent No.: US 8,967,442 B2
(45) Date of Patent: Mar. 3, 2015

(54) FILM TRANSPORT APPARATUS AND FILM TRANSPORT CONTROL METHOD

(75) Inventor: Toshio Fuwa, Nisshin (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 666 days.

(21) Appl. No.: 12/920,649

(22) PCT Filed: Mar. 4, 2009

(86) PCT No.: PCT/IB2009/000416

§ 371 (c)(1),
(2), (4) Date: Sep. 2, 2010

(87) PCT Pub. No.: WO2009/115881

PCT Pub. Date: Sep. 24, 2009

(65) Prior Publication Data

US 2011/0000948 A1 Jan. 6, 2011

(30) Foreign Application Priority Data

Mar. 17, 2008 (JP) ..... 2008-067101

(51) Int. Cl.
*B65H 23/02* (2006.01)
*B65H 23/032* (2006.01)

(52) U.S. Cl.
CPC ..... *B65H 23/032* (2013.01); *B65H 2553/822* (2013.01)
USPC ..... 226/3; 226/21

(58) Field of Classification Search
CPC ..... B65H 23/0204; B65H 23/0216; B65H 23/032–23/038; B21D 43/023; B21C 47/34; B21C 47/3408–47/3425; B21B 37/68; B21B 39/14–39/18; B21B 41/12
USPC ..... 226/3, 21–23
See application file for complete search history.

(56) References Cited

U.S. PATENT DOCUMENTS 4,381,586 A 5/1983 Abler
4,598,849 A * 7/1986 Frye et al. ..... 226/21
(Continued)

FOREIGN PATENT DOCUMENTS

DE 103 22 098 A1 12/2004
EP 0 216 964 A1 4/1987
(Continued)

OTHER PUBLICATIONS

Machine translation of JP 2004298890.*
(Continued)

*Primary Examiner* — William E Dondero
(74) *Attorney, Agent, or Firm* — Finnegan, Henderson, Farabow, Garrett & Dunner, LLP

(57) ABSTRACT

A film transport apparatus includes: an edge sensor that detects a lateral position deviation of a film; a lateral position correction device that corrects a lateral position of the film with a guide roll; a tension sensor that detects tensions applied respectively near left and right ends of the film; and a control unit that executes feedback control such that the lateral position correction device is controlled on the basis of the lateral position deviation detected by the edge sensor so that the film is located at a target position. The control unit changes the feedback control based on a left and right tension difference, which is a difference between the tension applied near the left end of the film and the tension applied near the right end of the film, the tensions being detected by the tension sensor.

18 Claims, 8 Drawing Sheets

(56) References Cited

U.S. PATENT DOCUMENTS

| | | | | |
|---|---|---|---|---|
| 4,896,807 | A * | 1/1990 | Mundschau | 226/21 |
| 5,058,793 | A * | 10/1991 | Neville et al. | 226/15 |
| 5,783,007 | A | 7/1998 | Boyd et al. | |
| 5,878,933 | A * | 3/1999 | Laughery | 226/21 |
| 5,894,797 | A * | 4/1999 | Brennan et al. | 101/226 |
| 6,085,956 | A * | 7/2000 | Sainio et al. | 226/4 |
| 6,543,353 | B1 * | 4/2003 | Ohlhauser et al. | 101/224 |
| 7,284,486 | B2 * | 10/2007 | Winter et al. | 101/485 |
| 2001/0040097 | A1 | 11/2001 | Arao et al. | |
| 2004/0045994 | A1 * | 3/2004 | Vaidyanathan et al. | 226/24 |
| 2004/0074942 | A1 | 4/2004 | Sorebo et al. | |

FOREIGN PATENT DOCUMENTS

| | | |
|---|---|---|
| EP | 0 761 583 A | 3/1997 |
| JP | 62-31650 | 2/1987 |
| JP | 4-153156 | 5/1992 |
| JP | 5-39528 | 2/1993 |
| JP | 2001-343223 | 12/2001 |
| JP | 2004-298890 | 10/2004 |

OTHER PUBLICATIONS

Machine translation of JP 5-39528.*

International Search Report in International Application No. PCT/IB2009/000461; Mailing Date: Sep. 21, 2009.

Notification of Reason(s) for Refusal in Japanese Patent Application No. 2008-067101; Drafting Date: Feb. 10, 2010.

Written Opinion of the International Searching Authority in International Application No. PCT/IB2009/000461; Mailing Date: Sep. 21, 2009.

* cited by examiner

FILM TRANSPORT APPARATUS AND FILM TRANSPORT CONTROL METHOD

CROSS-REFERENCE TO RELATED APPLICATIONS

This application is a national phase application of International Application No. PCT/IB2009/000416, filed Mar. 4, 2009, and claims the priority of Japanese Application No. 2008067101, filed Mar. 17, 2008, the contents of both of which are incorporated herein by reference.

BACKGROUND OF THE INVENTION

1. Field of the Invention

The invention relates to a film transport apparatus for transporting a film, which is a flexible sheet-like continuous material, and a film transport control method.

2. Description of the Related Art

A technique for transporting a film, which is a flexible sheet-like continuous material, such as a plastic film, a metal film, or a continuous paper, while supporting the film with a plurality of rollers has been suggested (which is, for example, described in Japanese Patent Application Publication No. 2001-343223 (JP-A-2001-343223)). Electrodes of a battery used in a hybrid car or an electric vehicle are handled in the form of a film in a manufacturing process. For a transport apparatus that transports the film, it is strongly required to increase a transport speed in order to reduce costs. In addition, to ensure quality, extremely high lateral position accuracy is required at the same time.

However, the lateral position varies due to misalignment of the roll or disturbance variations, such as variations in tension or speed, during transport. Thus, in the film transport apparatus, a guide roll is used to accurately control the lateral position of the film.

To correct the lateral position of the film the film tends to move so that the film is located perpendicular to the rotational axis of the guide roll if the guide roll is inclined with respect to the transport direction. As a result, the lateral position of the film is corrected.

However, in such a process of correcting the lateral position, it has been observed that wrinkling occurs in the film. The wrinkles degrade the quality of the product made of the film.

SUMMARY OF THE INVENTION

The invention provides a film transport apparatus and film transport control method that are able to prevent occurrence of a wrinkle in a film while the film is being transported.

A first aspect of the invention provides a film transport apparatus. The film transport apparatus that transports a film includes: lateral position deviation detecting means that detects the lateral position deviation of the film; lateral position correcting means that corrects the lateral position of the film with a guide roll; tension detecting means that detects tensions applied respectively near left and right ends of the film; and control means that executes feedback control to control the lateral position correcting means based on the lateral position deviation detected by the lateral position deviation detecting means so that the film is located at a target position. The control means changes the feedback control based on a left and right tension difference, which is a difference between the tension applied near the left end of the film and the tension applied near the right end of the film, as detected by the tension detecting means.

Here, the control means may calculate a transient left and right tension difference based on the left and right tension difference, and may change the feedback gain in the feedback control based on the calculated transient tension difference.

In addition, the control means may change the feedback gain such that the feedback gain decreases as the transient tension difference increases.

In particular, the control means may calculate the transient tension difference based on the left and right tension difference through a high-pass filtering process.

In addition, the control means may calculate a steady-state left and right tension difference based on the left and right tension difference, and may change the displacement limit of the guide roll in the feedback control based on the calculated steady-state tension difference.

Here, the control means may decrease the displacement limit as the steady-state tension difference increases.

In particular, the control means may calculate the steady-state tension difference based on the left and right tension difference through a low-pass filtering process.

Furthermore, the control means may adjust the feedback gain based on the estimated slippage between the guide roll and the film.

In addition, the control means may adjust the displacement limit based on the estimated slippage between the guide roll and the film.

A second aspect of the invention provides a film transport apparatus. The film transport apparatus that transports a film includes: lateral position deviation detecting means that detects the lateral position deviation of the film; lateral position correcting means that corrects the lateral position of the film with a guide roll; tension detecting means that detects a transport tension of the film; transport speed detecting means that detects a transport speed of the film; and control means that executes feedback control such that the lateral position correcting means is controlled based on the lateral position deviation detected by the lateral position deviation detecting means so that the film is located at a target position. The control means estimates the slippage between the guide roll and the film based on the transport tension of the film, detected by the tension detecting means, and the transport speed of the film, detected by the transport speed detecting means, and changes the feedback control based on the estimated slippage.

Here, the control means may change the feedback control such that the feedback gain increases as the estimated slippage increases.

In addition, the control means may change the feedback control such that the displacement limit of the guide roll increases as the estimated slippage increases.

A third aspect of the invention provides a film transport control method. The film transport control method includes: detecting the lateral position deviation of a film; detecting the tension applied near a left end of the film and the tension applied near a right end of the film to calculate a left and right tension difference between the detected tensions; and executing a feedback control to move the film laterally with a guide roll in order to reduce the lateral position deviation of the film based on the detected lateral position deviation and the left and right tension difference.

Here, a transient left and right tension difference may be calculated based on the left and right tension difference, and a feedback gain in the feedback control may be changed based on the calculated transient tension difference.

In addition, the feedback gain may be changed such that the feedback gain is decreased as the transient tension difference increases.

In addition, a steady-state left and right tension difference may be calculated based on the left and right tension difference, and a displacement limit of the guide roll in the feedback control may be changed based on the calculated steady-state tension difference.

In addition, the displacement limit may be reduced as the steady-state tension difference increases.

Furthermore, the feedback gain may be adjusted based on an estimated slippage between the guide roll and the film.

In addition, the displacement limit may be adjusted based on an estimated slippage between the guide roll and the film.

A fourth aspect of the invention provides a film transport control method. The film transport control method includes: detecting a lateral position deviation of a film; detecting a transport tension of the film; detecting a transport speed of the film; estimating a slippage between the guide roll and the film based on the detected transport tension and the detected transport speed; and executing a feedback control to move the film laterally with the guide roll to reduce the lateral position deviation of the film based on the detected lateral position deviation and the estimated slippage.

Here, the feedback control may be changed so that the feedback gain increases as the estimated slippage increases. In addition, the feedback control may be changed so that the displacement limit of the guide roll increases as the estimated slippage increases.

According to the aspects of the invention, it is possible to provide a film transport apparatus and film transport control method that are able to prevent occurrence of wrinkles in a film while the film is being transported.

BRIEF DESCRIPTION OF THE DRAWINGS

The features, advantages, and technical and industrial significance of this invention will be described in the following detailed description of example embodiments of the invention with reference to the accompanying drawings, in which like numerals denote like elements, and wherein.

DETAILED DESCRIPTION OF EMBODIMENTS

First, the configuration of a film transport apparatus according to a first embodiment will be described with reference to FIG. 1, FIG. 2A and FIG. 2B. The film transport apparatus 10 transports a film 20. Here, in the present embodiment, the film 20 is a material (metal thin film) of electrodes of a battery for driving a motor used in a hybrid car or an electric vehicle. The film 20 is, for example, a thin film sheet made of aluminum or copper having a thickness of several tens of μm.

Figure 1:
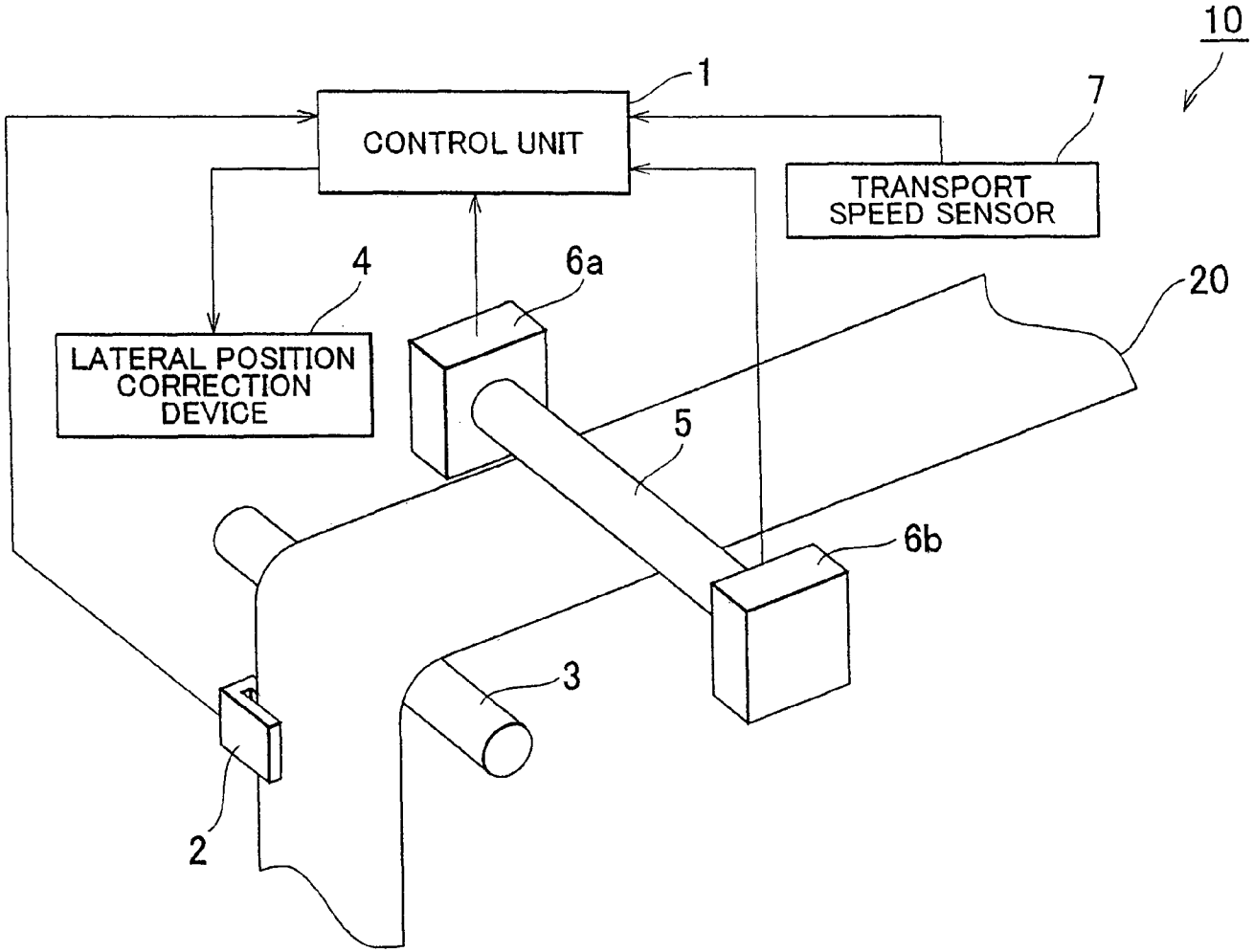
FIG. 1 is a view that shows the overall configuration of a film transport apparatus according to a first embodiment of the invention.
Figure 2A:
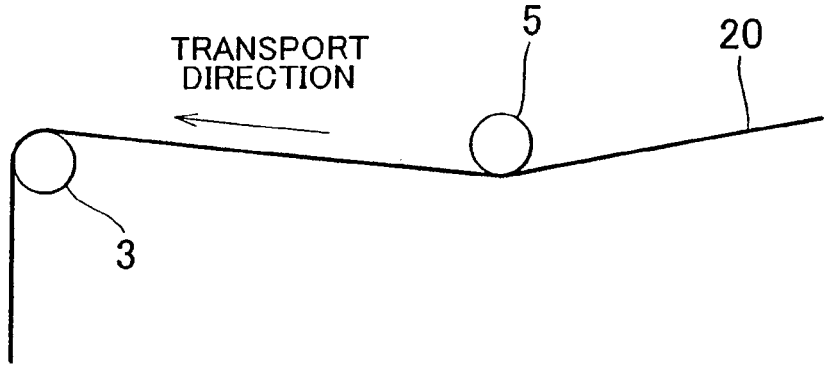
FIG. 2A is a side view of a principal part of the film transport apparatus according to the first embodiment of the invention.

As shown in FIG. 1, the film transport apparatus 10 includes a control unit 1, an edge sensor 2, a guide roll 3, a lateral position correction device 4, a free roll 5, tension sensors 6*a* and 6*b*, and a transport speed sensor 7. Although not shown in FIG. 1, the film transport apparatus 10 further includes a plurality of rollers, roller driving means, and the like, as components that are necessary to transport the film 20.

The control unit 1 is a controller formed of a CPU, a ROM, a RAM, and the like. The control unit 1 receives detection signals from the edge sensor 2, the tension sensors 6*a* and 6*b*, the transport speed sensor 7, and the like, and controls driving of transport rollers (not shown) and controls the lateral position correction device 4 to control the guide roller 3.

The control unit 1 corrects the position of the guide roll 3 by controlling the lateral position correction device 4 to laterally move the film 20 based on the lateral position information or lateral position deviation information of the film 20, detected by the edge sensor 2, so that the film 20 is located at a desired lateral position.

The control unit 1 according to the first embodiment specifically acquires information regarding a transient tension difference in such a manner that an absolute value of the tension difference between the tensions applied respectively near left and right ends of the film 20 is calculated based on the tension detected by the tension sensors 6*a* and 6*b* and the absolute value is then passed through a high-pass filter (high-frequency pass filter). Furthermore, the control unit 1 adjusts a feedback gain for the lateral position control, performed via the guide roll 5, based on the transient tension difference information.

The edge sensor 2 serves as lateral position deviation detecting means that detects the lateral position of the film 20 being transported, and outputs the detected lateral position to the control unit 1. The edge sensor 2 according to the present embodiment is provided downstream of the guide roll 3 and detects the lateral position of the film 20, of which the lateral position has been controlled by the guide roll 3. In FIG. 1, the edge sensor 2 is provided at one side end of the film 20, but it is not limited to this structure. The edge sensor 2 may also be provided, for example, at each side end instead.

Figure 2B:
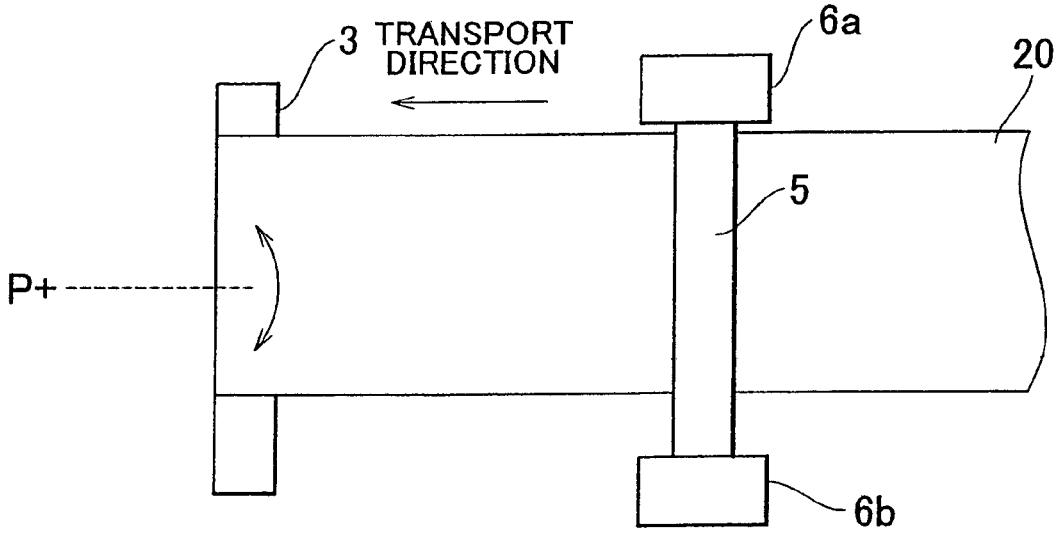
FIG. 2B is a top view of the principal part of the film transport apparatus according to the first embodiment of the invention.

As shown in FIG. 2B, the guide roll 3 is controlled by the lateral position correction device so that it is rotatable about point P. The guide roll 3 is a free roll that is freely rotatable. As shown in FIG. 2A, in the present embodiment, the film 20 is transported horizontally upstream of the guide roll 3 and is transported vertically downstream of the guide roll 3.

The lateral position correction device 4 controls the position of the guide roll 3 based on a control signal from the control unit 1 to correct the lateral position of the film 20. The lateral position correction device 4, for example, includes shaft support members that support the rotating shaft of the guide roll 3 and actuators that rotate the shaft support members along a horizontal surface. The shaft support members and the actuators are provided respectively at each end of the guide roll 3. Alternatively, one end of the guide roll 3 may be fixed, the other end is movable and the position of the movable end is controlled by a microscrew, a piezoelectric element, or the like.

The free roll 5 is a roll member that rotates while being in contact with the film 20. The free roll 5 is provided in order to detect the left and right end tensions of the film 20 by the tension sensors 6*a* and 6*b*. As shown in FIG. 2A, the free roll 5 is provided at a position that presses downward on the film 20.

The tension sensors 6*a* and 6*b* are force sensors (tension meters) that rotatably support both ends of the rotating shaft of the free roll 5 and that detect forces applied vertically upward at each ends of the free roll 5 to detect the tension applied respectively near left and right ends of the film 20. The control unit 1 acquires information regarding the tension difference between the tensions applied respectively near left and right ends of the film 20 based on the tension detected by the tension sensors 6*a* and 6*b*.

The transport speed sensor 7 detects the transport speed of the film 20, and outputs a detection signal that includes information regarding the detected transport speed to the control unit 1.

Next, a method of controlling the film transport apparatus according to the first embodiment will be described with reference to FIG. 3.

First, the control unit 1 receives detection signals that includes information regarding tensions applied respectively near left and right ends of the film 20, which is being transported, from the tension sensors 6*a* and 6*b* and calculates an absolute value of the tension difference between tensions applied respectively near left and right ends of the film 20 (hereinafter, simply referred to as "left and right tension difference") based on the detection signals. Furthermore, the control unit 1 executes a high-pass filtering (HPF) process on the calculated absolute value of the left and right tension difference to extract only a high-frequency component to thereby calculate the transient tension difference (S101).

Next, the control unit 1 calculates a feedback gain based on a map that associates the transient tension difference with a feedback gain (S102). Here, the feedback gain indicates sensitivity (responsivity) of feedback in a control loop by which the position of the guide roll 3 is actuated by the lateral position correction device 4 in order to return the film 20 to a desired position depending on a lateral deviation of the film 20, detected by the edge sensor 2. That is, if the feedback gain is small, the detected lateral deviation of the film 20 is corrected for a relatively long period of time (in the specification, this case is described that a correction speed is slow), while if the feedback gain is large, the lateral deviation is corrected for a relatively short period of time (in the specification, this case is described that a correction speed is fast).

Figure 4:
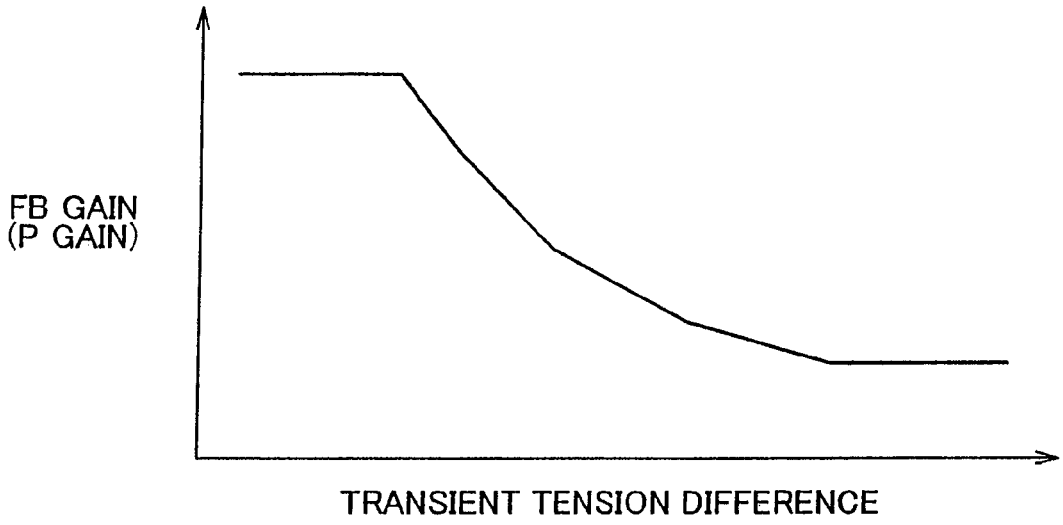
FIG. 4 is a conceptual view of a map used in the film transport control method according to the first embodiment of the invention.

The conceptual view of the map is shown in FIG. 4. As shown in FIG. 4, the feedback gain and the transient tension difference are associated with each other in the map so that, basically, the feedback gain is decreased as the transient tension difference increases, and the feedback gain is increased as the transient tension decreases. The reason why the transient tension difference and the feedback gain are thus associated in the map will be described below.

The inventors analyzed a wrinkle that occurs in the film 20 while it is being transported and found that the wrinkle is caused by a left and right tension difference that occurs in the film 20 when the guide roll 3 is inclined by the lateral position correction device 4. Furthermore, specifically, when the feedback gain is reduced, the left and right tension difference is relatively small, so wrinkling is less likely to occur. However, correction of a lateral deviation (edge deviation) takes time and, therefore, a steady-state deviation remains when a large edge deviation occurs. On the other hand, if the feedback gain is increased, the left and right tension difference is relatively large, so wrinkling is more likely to occur.

In addition, the inventors focused on the fact that there are a transient left and right tension difference and a steady-state left and right tension difference. Then, as a result of analysis, it has been found that the transient left and right tension difference mainly occurs due to inclination control of the guide roll 3, and the steady-state left and right tension difference mainly occurs due to variations in transport tension, variations in transport speed, a disturbance caused by a processing machine that processes the film 20 while it is being transported, a disturbance caused by a position deviation of a fixed roll, and the like.

In the first embodiment, in order to prevent occurrence of wrinkling due to the transient left and right tension difference, the high-pass filter is employed as means for extracting a transient component from the left and right tension difference. Then, as shown by the conceptual view of the map in FIG. 4, the map is set so that the feedback gain is increased as the transient tension difference decreases, and the feedback gain is decreased as the transient tension difference increases. Accordingly, it is possible to suppress occurrence of a steady-state deviation while preventing occurrence of wrinkling. Note that the trouble that occurs due to the steady-state left and right tension difference is handled by a film transport control method according to a second embodiment of the invention.

Figure 3:
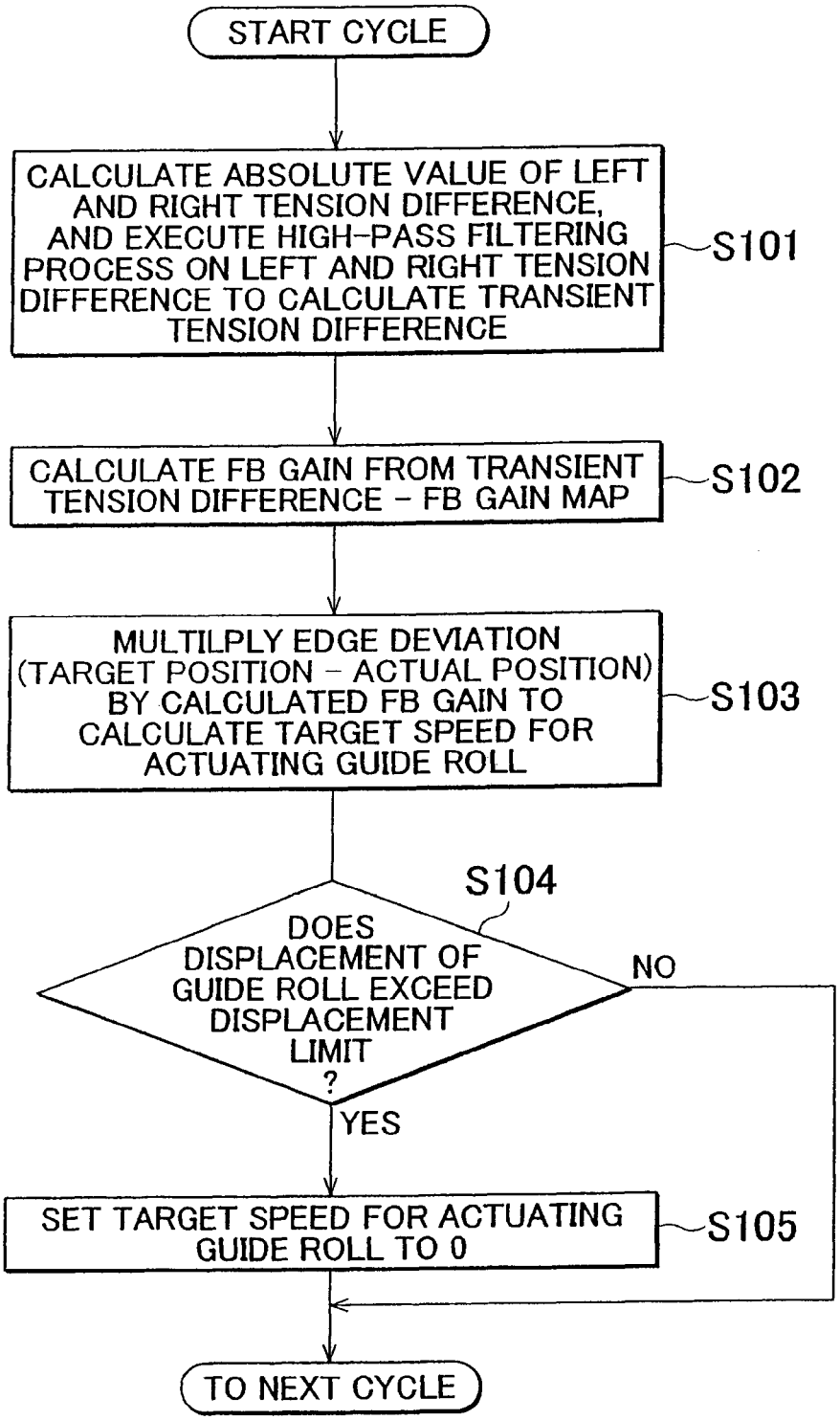
FIG. 3 is a flowchart that shows the process flow in a film transport control method according to the first embodiment of the invention.

The description returns to the description of the flowchart of FIG. 3. The control unit 1 calculates the amount of lateral deviation of the film 20 from a target position (edge deviation) based on the positional information of the film 20 detected by the edge sensor 2 and, in addition, calculates a target speed for driving the guide roll by multiplying the edge deviation by the feedback gain calculated in step S102 (S103).

Subsequently, the control unit 1 calculates the displacement of the guide roll (guide roll displacement) necessary to achieve the calculated target speed and then determines whether the guide roll displacement exceeds a displacement limit (limit value) (S104). The displacement limit is preset in the control unit 1.

If the control unit 1 determines that the guide roll displacement exceeds the displacement limit, the control unit 1 sets the target speed for actuating the guide roll to 0 and then proceeds to a process of the next cycle (S105). IF the target speed for actuating the guide roll is set to 0, the guide roll 3 stops and does not cross over the displacement limit.

On the other hand, if the control unit 1 determines that the guide roll displacement does not exceed the displacement limit, that is, the guide roll displacement is smaller than or equal to the displacement limit, the control unit 1 controls the lateral position correction device 4 to move the guide roll 3 and corrects the lateral position of the film 20 based on the target speed calculated in step S103.

As described above, in the film transport apparatus according to the first embodiment, the transient tension difference of the film 20 while it is being transported is detected, the feedback gain is increased as the detected transient tension difference decreases, and the feedback gain is decreased as the transient tension difference increases. In this way, lateral position correction control is performed. By so doing, it is possible to suppress occurrence of a steady-state deviation while preventing wrinkling.

The film transport apparatus according to the second embodiment of the invention has the function of handling the trouble that occurs due to the steady-state left and right tension difference. The overall configuration of the film transport apparatus is similar to the configuration shown in FIG. 1. A method of controlling the film transport apparatus according to the second embodiment will be described with reference to FIG. 5.

First, the control unit 1 receives detection signals that include information regarding tensions applied respectively near left and right ends of the film 20, which is being transported, from the tension sensors 6*a* and 6*b* and calculates an absolute value of a left and right tension difference of the film 20 on the basis of the detection signals. Furthermore, the control unit 1 executes a low-pass filtering (LPF) process on the calculated absolute value of the left and right tension difference to extract only a low-frequency component to thereby calculate a steady-state tension difference (S201).

Next, the control unit 1 calculates a displacement limit based on a map that associates a steady-state tension difference with a displacement limit (S202). The displacement limit and the steady-state tension difference are associated with each other in the map so that, basically, the displacement limit is reduced as the steady-state tension difference increases, and the displacement limit is increased as the transient tension difference decreases. The reason why the steady-state tension difference and the displacement limit are thus associated in the map will be described below.

If the displacement of the guide roll 3 increases, the amount of correction in lateral position of the film 20 also increases. At this time, a large displacement of the guide roll 3 increases the misalignment of the guide roll, which thereby increases the steady-state tension difference of the film 20. As a result, wrinkles are more likely to occur. In addition, if the lateral position of the film 20 has deviated due to variations in transport tension, variations in speed, a disturbance caused by a processing machine, a disturbance caused by misalignment of a fixed roll, and the like, and, therefore, the left and right tension difference is large, when the guide roll 3 is then moved by a large amount, the steady-state tension difference of the film 20 increases and, as a result, wrinkling is even more likely to occur.

In the second embodiment, in order to extract a steady-state component from the left and right tension difference, a low-pass filter is employed.

Figure 5:
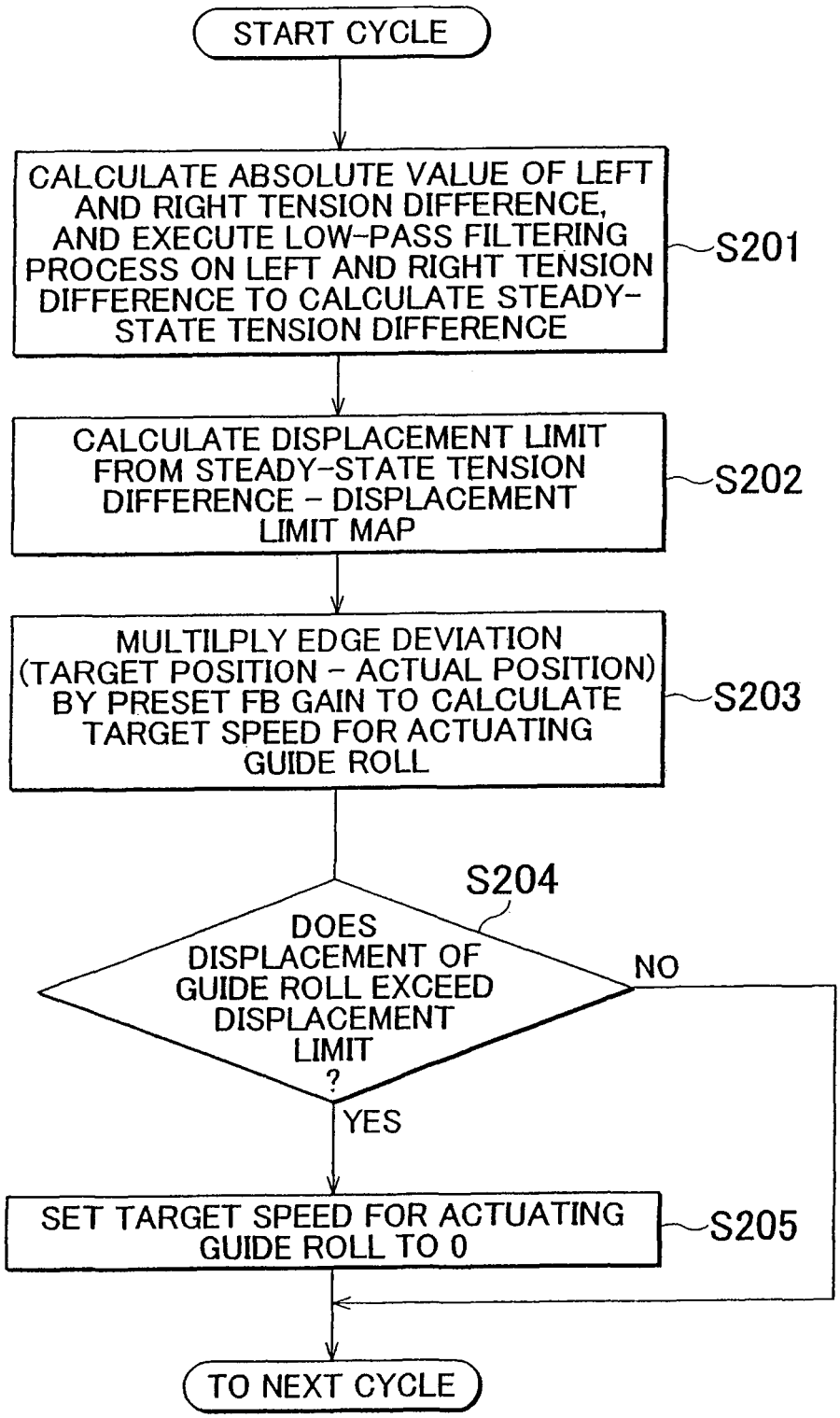
FIG. 5 is a flowchart that shows the process flow in a film transport control method according to a second embodiment of the invention.

As shown in FIG. 5, the control unit 1 calculates the amount of lateral deviation of the film 20 from a target position (edge deviation) based on the positional information of the film 20 detected by the edge sensor 2 and, in addition, calculates a target speed for actuating the guide roll by multiplying the edge deviation by the predetermined feedback gain (S203).

Subsequently, the control unit 1 calculates the guide roll displacement necessary to achieve the calculated target speed and then determines whether the guide roll displacement exceeds the displacement limit calculated in step 202 (S204).

If the control unit 1 determines that the guide roll displacement exceeds the displacement limit, the control unit 1 sets the target speed for actuating the guide roll to 0 and then proceeds to a process of the next cycle (S205). IF the target speed for actuating the guide roll is set to 0, the guide roll 3 stops and does not cross over the displacement limit.

On the other hand, when the control unit 1 determines that the guide roll displacement does not exceed the displacement limit, that is, the guide roll displacement is smaller than or equal to the displacement limit, the control unit 1 controls the lateral position correction device 4 to move the guide roll 3 and corrects the lateral position of the film 20 based on the target speed calculated in step S203.

As described above, in the film transport apparatus according to the second embodiment, the steady-state tension difference of the film 20 while it is being transported is detected, the displacement limit of the guide roll 3 is increased as the detected steady-state tension difference decreases, and the displacement limit is reduced as the steady-state tension difference increases. Accordingly, when the displacement limit is reduced, the performance of correction of the lateral position of the film 20 is decreased, but occurrence of wrinkling may be prevented. Then, when a disturbance factor that causes the left and right tension difference is eliminated and then the steady-state tension difference is sufficiently reduced, the displacement limit increases and, as a result, the performance of the lateral position correction control improves. Thus, it is possible to obtain a control system that takes into consideration the trade-off relationship between occurrence of a wrinkle and correction of lateral position.

Note that in the control according to the first embodiment of the invention, setting the displacement limit may be executed as in the case of the second embodiment of the invention. Thus, it is possible to suppress the occurrence of wrinkling and to control performance.

A third embodiment of the invention will be described. In the first and second embodiments of the invention, the feedback gain or the displacement limit of the guide roll is changed based on the left and right tension difference of the film 20. This prevents occurrence of wrinkling by taking into consideration that the left and right tension difference is further increased when a fast feedback correction (that is, an increase in feedback gain) or a large correction is performed in a situation that the left and right tension difference is already large due to a disturbance or a slack of the film 20.

Here, the left and right tension difference that occurs in the film 20 generates a shear force in the film 20. The inventors found that the likelihood of wrinkling varies depending on the slippage between the guide roll 3 and the film 20 against the shear force generated in the film 20. Here, the slippage indicates the likelihood of slip between the guide roll 3 and the film 20, and is inversely proportional to a frictional force between the guide roll 3 and the film 20.

Specifically, if the slippage is sufficiently small against the shear force, a compression force acts on the film 20 and then buckling occurs. This causes wrinkling to occur in the film 20. On the other hand, if the slippage is large against the shear force, buckling does not occur even when the shear force, that is, the left and right tension difference, is large. Thus, wrinkling does not occur.

In the third embodiment, the slippage is used, in addition to the left and right tension difference used in the first and second embodiments, as a parameter by which the likelihood of occurrence of wrinkling is evaluated. Thus, it is possible to further accurately estimate the likelihood of occurrence of wrinkling.

Figure 6:
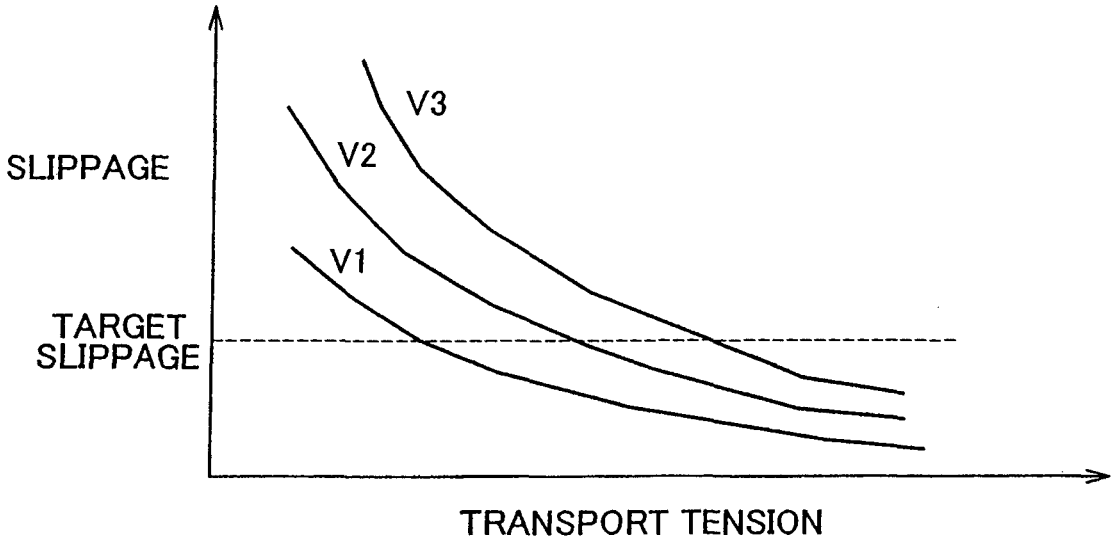
FIG. 6 is a conceptual view of a map used in a film transport control method according to a third embodiment of the invention.

Here, the slippage may be estimated based on the current transport speed and the current transport tension. FIG. 6 is a conceptual view of a map that shows the relationship among slippage, transport speed and transport tension. In the drawing, transport speeds V1, V2 and V3 have the relationship V1<V2<V3.

As shown in FIG. 6, the slippage decreases as the transport tension increases. This is because as the transport tension increases, the frictional force between the film 20 and the guide roll 3 increases. In addition, the slippage increases as the transport speed increases. This is because as the transport speed increases, the frictional force between the film 20 and the guide roll 3 decreases.

Figure 7:
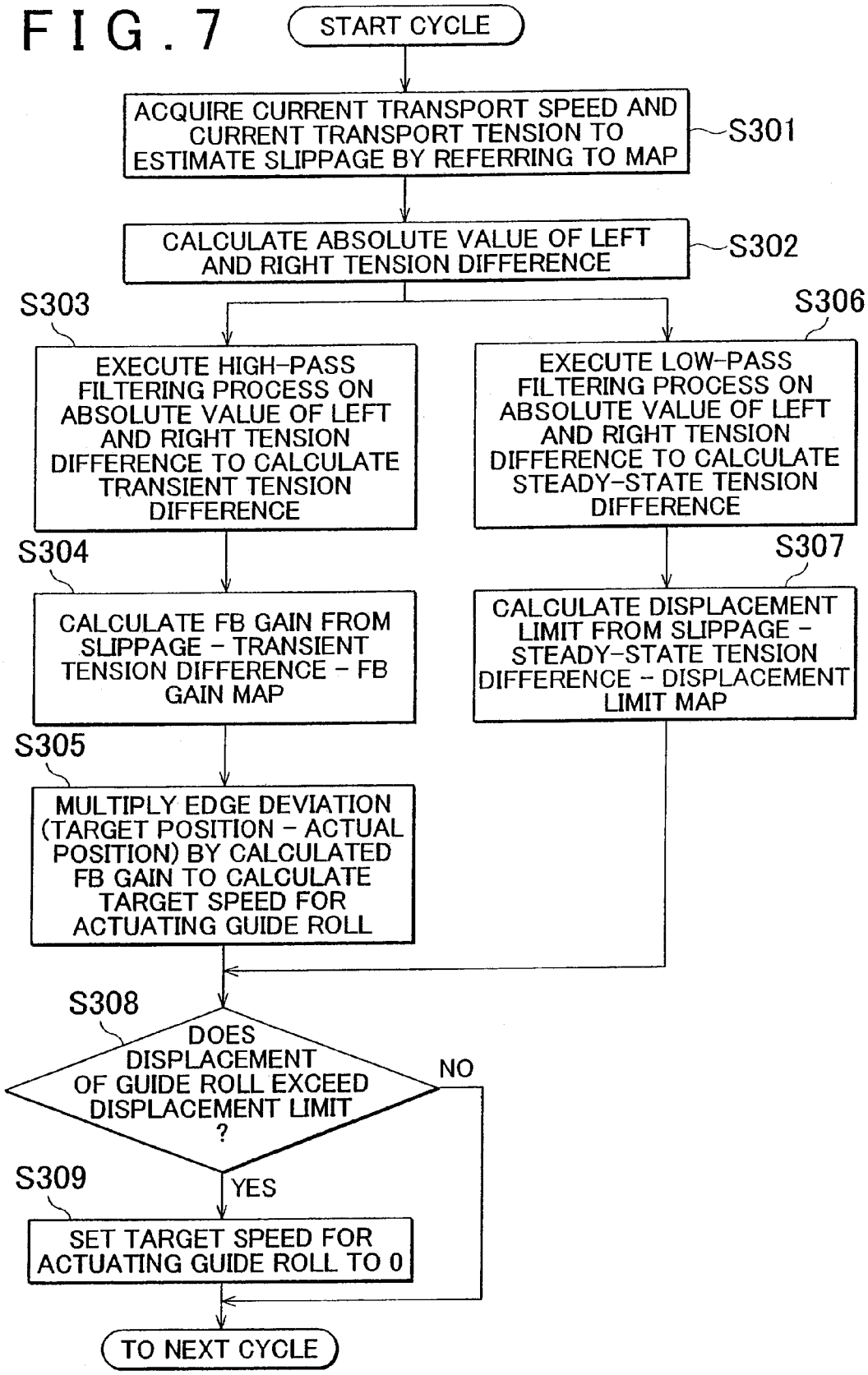
FIG. 7 is a flowchart that shows the process flow in the film transport control method according to the third embodiment of the invention.

Next, the flow of control of the film transport apparatus according to the third embodiment will be described with reference to the flowchart shown in FIG. 7. First, the control unit 1 acquires the transport speed of the film 20, detected by the transport speed sensor 7. In addition, the control unit 1 acquires the transport tension of the film 20, detected by the tension sensors 6*a* and 6*b*. At this time, because the tension sensor 6*a* and the tension sensor 6*b* respectively detect left and right tensions of the film 20, so the detected tensions are converted into the transport tension of the film 20 by, for example, averaging the detected tensions. In addition, the control unit 1 estimates the slippage by referring to the map shown in FIG. 6 based on the acquired transport speed and transport tension (S301).

Furthermore, the control unit 1 calculates an absolute value of the left and right tension difference based on the left and right tensions detected by the tension sensors 6*a* and 6*b* (S302).

The control unit 1 executes a high-pass filtering (HPF) process on the calculated absolute value of the left and right tension difference to extract a high-frequency component and thereby calculate a transient tension difference (S303).

Figure 8:
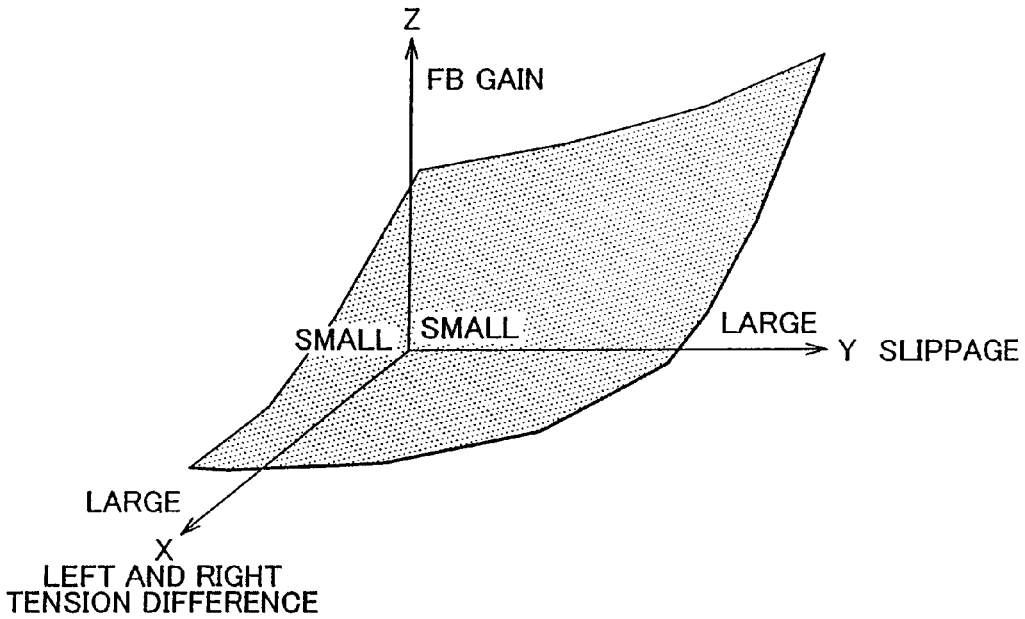
FIG. 8 is a conceptual view of a map used in the film transport control method according to the third embodiment of the invention.

Next, the control unit 1 calculates a feedback gain based on a map that associates the slippage, the transient tension difference, and the feedback gain (S304). The conceptual view of the map is shown in FIG. 8. As shown in FIG. 8, in the map, basically, the feedback gain is decreased as the transient tension difference increases, and the feedback gain is increased as the transient tension difference decreases. In addition, the feedback gain is increased as the slippage increases, and the feedback gain is decreased as the slippage decreases.

The control unit 1 calculates the amount of lateral deviation of the film 20 from a target position (edge deviation) based on the positional information of the film 20 detected by the edge sensor 2 and, in addition, calculates a target speed for actuating the guide roll by multiplying the edge deviation by the feedback gain calculated in step S304 (S305).

On the other hand, the control unit 1 executes a low-pass filtering (LPF) process on the calculated absolute value of the left and right tension difference to extract a low-frequency component and thereby calculate a steady-state tension difference (S306).

Figure 9:
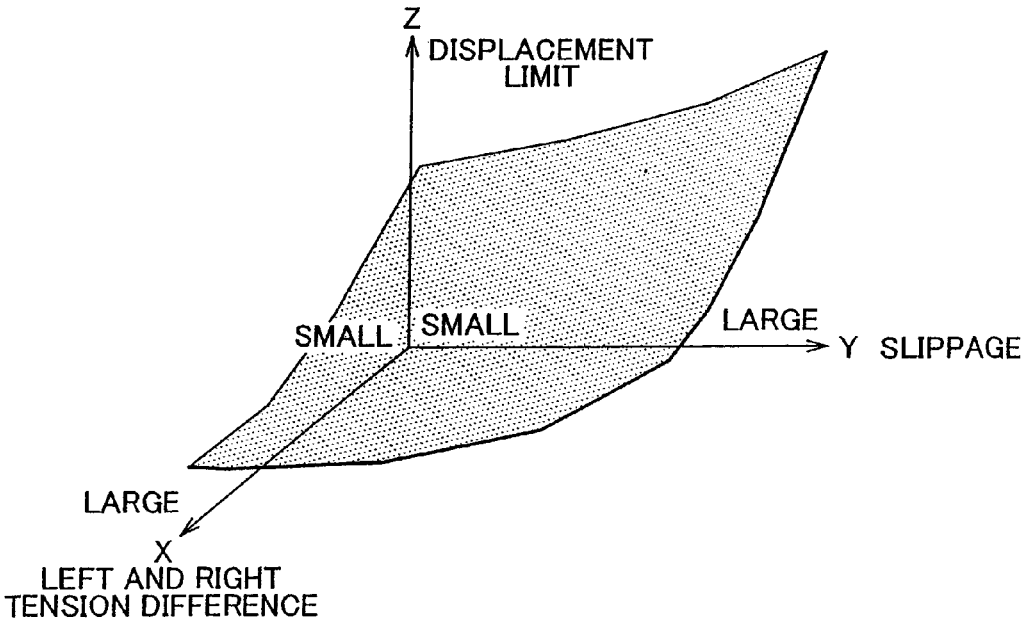
FIG. 9 is a conceptual view of a map used in the film transport control method according to the third embodiment of the invention.

Next, the control unit 1 calculates a displacement limit based on a map that associates a slippage, a steady-state tension difference and a displacement limit (S307). The conceptual view of the map is shown in FIG. 9. In the map, basically, the displacement limit is decreased as the steady-state tension difference increases, and the displacement limit is increased as the transient tension difference decreases. In addition, the displacement limit is increased as the slippage increases, and the displacement limit is decreased as the slippage decreases.

Subsequently, the control unit 1 calculates the guide roll displacement necessary to achieve the calculated target speed and then determines whether the guide roll displacement exceeds the displacement limit calculated in step 307 (S308).

If the control unit 1 determines that the guide roll displacement exceeds the displacement limit, the control unit 1 sets the target speed for actuating the guide roll to 0 and then initiates the next cycle (S309). IF the target speed for actuating the guide roll is set to 0, the guide roll 3 stops and does not cross over the displacement limit.

On the other hand, if the control unit 1 determines that the guide roll displacement does not exceed the displacement limit, that is, the guide roll displacement is smaller than or equal to the displacement limit, the control unit 1 controls the lateral position correction device 4 to move the guide roll 3 and corrects the lateral position of the film 20 based on the target speed calculated in step 5305.

As described above, in the film transport apparatus according to the third embodiment, the transient tension difference of the film 20 while it is being transported is detected, the feedback gain is increased as the detected transient tension difference decreases, and the feedback gain is reduced as the transient tension difference increases. By so doing, it is possible to suppress the occurrence of a steady-state deviation while preventing the occurrence of wrinkles.

In addition, in the film transport apparatus according to the third embodiment, the steady-state tension difference of the film 20 while it is being transported is detected, the displacement limit of the guide roll 3 is increased as the detected steady-state tension difference reduces, and the displacement limit is reduced as the steady-state tension difference increases. By controlling the displacement limit of the guide roll 3 in this manner, when the displacement limit is reduced, the performance of correction of the lateral position of the film 20 is decreased, but occurrence wrinkles may be prevented. Then, if a disturbance factor that causes the left and right tension difference is eliminated and then the steady-state tension difference is sufficiently reduced, the performance of the lateral position correction control improves. Thus, it is possible to obtain a control system that takes into consideration the trade-off relationship between occurrence of a wrinkle and correction of lateral position.

Furthermore, in the film transport apparatus according to the third embodiment, because the slippage is estimated based on the transport speed and the transport tension and then the feedback gain and the displacement limit are adjusted based on the slippage, it is possible to further accurately suppress occurrence of wrinkles.

Note that in the third embodiment, the control based on the slippage is combined with the control based on the left and right tension difference according to the first and second embodiments of the invention, however, it is not limited to the third embodiment. A control only based on the slippage may be implemented.

While the invention has been described with reference to example embodiments thereof, it is to be understood that the invention is not limited to the described embodiments or constructions. To the contrary, the invention is intended to cover various modifications and equivalent arrangements. In addition, while the various elements of the example embodiments are shown in various combinations and configurations, other combinations and configurations, including more, less or only a single element, are also within the scope of the invention.

The invention claimed is:

1. A film transport apparatus that transports a film, comprising:

a lateral position deviation detecting portion that detects a lateral position deviation of the film;

a lateral position correcting portion that corrects a lateral position of the film with a guide roll;

a tension detecting portion that detects tensions applied respectively near left and right ends of the film; and a control portion that executes feedback control such that the lateral position correcting portion is controlled based on the lateral position deviation detected by the lateral position deviation detecting portion so that the film is located at a target position, wherein the control portion changes the feedback control based on a left and right tension difference, which is the difference between the tension applied near the left end of the film and the tension applied near the right end of the film, the tensions being detected by the tension detecting portion;

the control portion calculates a transient left and right tension difference based on the left and right tension difference;

the control portion calculates a gain value based on the transient left and right tension difference, the transient left and right tension difference being related to the gain value such that the gain value decreases as the transient left and right tension difference increases; and the control portion calculates a target speed for actuating the guide by multiplying the lateral position deviation by the gain value.

2. The film transport apparatus according to claim 1, wherein the control portion calculates the transient left and right tension difference by subjecting the left and right tension difference to a high-pass filtering process.

3. The film transport apparatus according to claim 1, wherein the control portion calculates a steady-state left and right tension difference based on the left and right tension difference, and changes a displacement limit of the guide roll in the feedback control based on the calculated steady-state left and right tension difference.

4. The film transport apparatus according to claim 3, wherein the control portion decreases the displacement limit as the steady-state left and right tension difference increases.

5. The film transport apparatus according to claim 3, wherein the control calculates the steady-state left and right tension difference by subjecting the left and right tension difference to a low-pass filtering process.

6. The film transport apparatus according to claim 3, wherein the control portion adjusts the displacement limit based on an estimated slippage between the guide roll and the film.

7. The film transport apparatus according to claim 1, wherein the control portion adjusts the feedback gain based on an estimated slippage between the guide roll and the film.

8. The film transport apparatus according to claim 1, wherein the film transport apparatus further comprises a transport speed detecting portion that detects a transport speed of the film; and the control portion estimates a slippage between the guide roll and the film based on a transport tension of the film, detected by the tension detecting portion, and the transport speed of the film, detected by the transport speed detecting portion, and changes the feedback control based on the estimated slippage.

9. The film transport apparatus according to claim 8, wherein the control portion changes the feedback control such that the feedback gain is increased as the estimated slippage increases.

10. The film transport apparatus according to claim 8, wherein the control portion changes the feedback control such that a displacement limit of the guide roll is increased as the estimated slippage increases.

11. A film transport control method comprising:

detecting a lateral position deviation of the film:

detecting a tension applied near a left end of the film and a tension applied near a right end of the film to calculate a left and right tension difference between the detected tensions; and executing a feedback control to move the film laterally with a guide roll in order to reduce the lateral position deviation of the film based on the detected lateral position deviation and the left and right tension difference, wherein the execution of the feedback control includes:

calculating a transient left and right tension difference based on the left and right tension difference;

calculating a gain value based on the transient left and right tension difference, the transient left and right tension difference being related to the gain value such that the gain value decreases as the transient left and right tension difference increases; and calculating a target speed for actuating the guide roll by multiplying the lateral position deviation by the gain value.

12. The film transport control method according to claim 11, wherein the execution of the feedback control includes:

calculating a steady-state left and right tension difference based on the left and right tension difference; and changing a displacement limit of the guide roll in the feedback control based on the calculated steady-state left and right tension difference.

13. The film transport control method according to claim 12, wherein the displacement limit is decreased as the steady-state left and right tension difference increases.

14. The film transport control method according to claim 12, wherein the displacement limit is adjusted based on an estimated slippage between the guide roll and the film.

15. The film transport control method according to claim 11, wherein the feedback gain is adjusted based on an estimated slippage between the guide roll and the film.

16. The film transport control method according to claim 11, further comprising:

detecting a transport tension of the film;

detecting a transport speed of the film;

estimating a slippage between a guide roll and the film based on the detected transport tension and the detected transport speed; and executing a feedback control such that the film is moved laterally with the guide roll to reduce the lateral position deviation of the film based on the detected lateral position deviation and the estimated slippage.

17. The film transport control method according to claim 16, wherein the feedback control is changed so that a feedback gain is increased as the estimated slippage increases.

18. The film transport control method according to claim 16, wherein the feedback control is changed so that a displacement limit of the guide roll is increased as the estimated slippage increases.

* * * * *